US007594461B2

(12) United States Patent
Aichele et al.

(10) Patent No.: US 7,594,461 B2
(45) Date of Patent: Sep. 29, 2009

(54) ROTARY CUTTING DEVICE, A METHOD FOR DISENGAGING A ROTARY CUTTING DEVICE AND A METHOD OF OPERATING A ROTARY CUTTING DEVICE

(75) Inventors: Wilhelm Aichele, Crailsheim (DE); Matthias Aichele, Crailsheim (DE)

(73) Assignee: Aichele Werkzeuge GmbH, Crailsheim (DE)

( * ) Notice: Subject to any disclaimer, the term of this patent is extended or adjusted under 35 U.S.C. 154(b) by 110 days.

(21) Appl. No.: 11/429,616

(22) Filed: May 4, 2006

(65) Prior Publication Data

US 2006/0257193 A1 Nov. 16, 2006

(30) Foreign Application Priority Data

May 11, 2005 (DE) ..... 10 2005 022 604

(51) Int. Cl.
*B26D 7/22* (2006.01)

(52) U.S. Cl. ..... 83/344; 83/346; 83/506

(58) Field of Classification Search ..... 83/344, 83/346, 343, 347, 348, 528, 564, 506
See application file for complete search history.

(56) References Cited

U.S. PATENT DOCUMENTS

| | | | | |
|---|---|---|---|---|
| 3,196,615 | A * | 7/1965 | Kautz | 60/402 |
| 3,877,336 | A | 4/1975 | Hillesheimer | |
| 4,014,234 | A | 3/1977 | Spengler | |
| 4,218,943 | A | 8/1980 | Osburg | |
| 4,527,473 | A * | 7/1985 | Littleton | 83/170 |
| 4,618,342 | A | 10/1986 | Borel | |
| 4,759,247 | A * | 7/1988 | Bell et al. | 83/346 |
| 5,174,185 | A | 12/1992 | Aichele | |
| 5,575,202 | A | 11/1996 | Pfeiffer | |
| 6,158,316 | A * | 12/2000 | Ichikawa et al. | 83/347 |
| 6,244,148 | B1 | 6/2001 | Vees | |
| 6,684,747 | B2 | 2/2004 | Aichele | |
| 7,146,893 | B2 * | 12/2006 | Aichele | 83/346 |
| 2002/0000143 | A1 | 1/2002 | Okonski | |
| 2002/0029675 | A1 | 3/2002 | Aichele | |
| 2002/0144580 | A1 | 10/2002 | Aichele | |

FOREIGN PATENT DOCUMENTS

| | | |
|---|---|---|
| DE | 2 254 281 | 11/1972 |
| DE | 23 57 820 | 5/1975 |
| DE | 26 21 505 | 12/1977 |
| DE | 27 43 561 | 3/1979 |
| DE | 39 24 053 | 1/1991 |
| EP | 0 611 187 | 8/1994 |
| EP | 0 685 305 | 12/1995 |
| EP | 0 841 133 | 5/1998 |
| EP | 0 976 510 | 2/2000 |
| EP | 1 180 419 | 2/2002 |
| EP | 1 186 387 | 3/2002 |
| EP | 1 238 765 | 9/2002 |
| GB | 1 476 421 | 6/1977 |
| GB | 2 089 710 | 6/1982 |

* cited by examiner

*Primary Examiner*—Stephen Choi
(74) *Attorney, Agent, or Firm*—Lipsitz & McAllister, LLC

(57) ABSTRACT

A rotary cutting device is provided comprising a rotatably mounted cutting roller and an anvil roller. At least one support ring is provided for supporting the cuffing roller on the anvil roller. A lifting device is provided for moving the cutting roller and the anvil roller apart.

33 Claims, 2 Drawing Sheets

ROTARY CUTTING DEVICE, A METHOD FOR DISENGAGING A ROTARY CUTTING DEVICE AND A METHOD OF OPERATING A ROTARY CUTTING DEVICE

The present disclosure relates to the subject matter disclosed in German application number 10 2005 022 604.3 of May 11, 2005, which is incorporated herein by reference in its entirety and for all purposes.

BACKGROUND OF THE INVENTION

The invention relates to a rotary cutting device comprising a rotatably mounted cutting roller and an anvil roller wherein at least one support ring is provided for supporting the cutting roller on the anvil roller.

Furthermore, the invention relates to a method for disengaging a rotary cutting device incorporating a rotatably mounted cutting roller and an anvil roller.

Furthermore, the invention relates to a method of operating a rotary cutting device incorporating a rotatably mounted cutting roller and an anvil roller.

Rotary cutting devices are known from EP 0 976 510 A2, EP 1 180 419 A1, EP 1 186 387 A2 or EP 1 238 765 A2 for example.

SUMMARY OF THE INVENTION

In accordance with the invention, a rotary cutting is provided which exhibits increased freedom from malfunction.

In accordance with an embodiment of the invention, a lifting device is provided for the purposes of moving the cutting roller and the anvil roller apart.

It is usual for the cutting roller to be pressed against the anvil roller for carrying out the cutting process. If the cutting roller is no longer being driven, due to a defined disconnection of a drive or due to an emergency stop for example, then the contact pressure is also reduced. In consequence, sliding friction between the cutting roller and the anvil roller becomes relevant and this can lead to increased wear. Moreover, a cold welding process could occur. The cutting roller and the anvil roller can be moved apart by means of the lifting device in order to prevent mechanical contact and hence sliding friction. Thus, by virtue of the solution in accordance with the invention, the wear can be reduced.

It is also possible for example for foreign bodies such as metallic foreign bodies to be contained in a web of material that is to be cut. These can lead to increased wear of the cutting edges of a cutter device of the cutting roller. In principle, such foreign bodies can be detected by sensors. The lifting device can be controlled by a corresponding sensor signal in order to move the cutting roller and the anvil roller apart and thus prevent contact between the foreign body and the cutter device. Wear is also reduced thereby.

In particular, the spacing between the cutting roller and the anvil roller is adapted to be increased by the lifting device in such a way that contact between the cutting roller and the anvil roller no longer exists. In particular, they then no longer touch. In consequence, mechanical contact between the cutting roller and the anvil roller no longer exists and sliding friction is prevented.

In particular, the cutting roller and the anvil roller are movable away from one another in a translatory manner by the lifting device in order to prevent sliding friction.

Provision is made for the cutting roller and the anvil roller to be movable away from one another by the lifting device in a direction transverse to the axis of rotation of the cutting roller. The spacing between the cutting roller and the anvil roller can thereby be increased in order to "break" a mechanical contact.

In one embodiment, the anvil roller is fixed in a translatory sense and the cutting roller is movable in a translatory manner relative to the anvil roller by means of the lifting device. Such a rotary cutting device has a favourable constructional structure. Thus, for example, the cutting roller can be pressed against the anvil roller in a simple manner in order to have a bias force for the cutting process. The spacing between the cutting roller and the anvil roller can be increased against this bias force by means of the lifting device.

Alternatively, it is also possible for the cutting roller to be fixed in a translatory sense and for the anvil roller to be movable in a translatory manner relative to the cutting roller by means of the lifting device. In principle it is also possible for both the cutting roller and the anvil roller to be movable in a translatory manner.

It is particularly very advantageous, if the lifting device is adapted to be activated in a controlled manner for the purposes of moving the cutting roller and the anvil roller apart. Initiation signals can then be made available in order to cause the separating movement. An initiation signal can be coupled with stoppage of a drive, emergency stoppage of the rotary cutting device or detection of a foreign body for example.

In particular, a lifting device control system is coupled to a drive control system for the rotary cutting device. If a drive is switched off (when disengaging the rotary cutting device or in the case of an emergency stop for example), then a separating movement of the cutting roller and the anvil roller relative to one another can be achieved thereby in order to prevent sliding friction. In consequence, a defined disengagement or a defined emergency stop for the rotary cutting device can be achieved even in the case of cutting rollers of large mass (and thus large inertia of mass). Increased wear is thereby prevented and the rotary cutting device can be operated in a more trouble-free manner. The lifting device can also be activated when threshold values are reached (for decelerating the rotary motion of the cutting roller for example).

In particular, the lifting device control system is coupled to a drive control system for the cutting roller in order to obtain a defined separating movement when switching the drive off or when exceeding/falling below a speed threshold or an acceleration threshold or a deceleration threshold for the (rotary) motion of the cutting roller for example.

Provision may also be made for a lifting device control system to be coupled to one or more sensors in order to enable a separating movement to be initiated by a sensor signal.

For example, the lifting device control system is connected to one or more cut-goods sensors. A separating movement can thereby be initiated in the event of detection of a foreign body for example.

It is expedient if the lifting device is adapted to be activated by the act of exceeding/falling below a threshold value for the speed and/or the acceleration and/or the deceleration of the cutting roller and/or the anvil roller. In particular, the lifting device control system is coupled to a respective drive control system for the cutting roller or the anvil roller so that it is possible to monitor via the lifting device control system as to whether a certain threshold value is being exceeded, for example, in regard to the deceleration of the rotary motion of the cutting roller or the anvil roller, in order to activate the process of lifting the cutting roller up from the anvil roller. Malfunctioning can be prevented in this manner.

It is expedient if the lifting device is adapted to be activated by an emergency stop. A defined separating movement can thereby be achieved even in the event of an emergency stoppage (of the cutting roller or the rotary cutting device or of a plant which comprises the rotary cutting device).

In particular, there is provided a drive for the cutting roller, i.e. the cutting roller is driven for carrying out the cutting process.

It is expedient if the lifting device is supported on a machine frame. The lifting device can thus be implemented in a constructionally simple manner and accommodated in a space-saving manner.

It is particularly very advantageous, if the lifting device comprises an energy storage arrangement. A separating movement can then be achieved even if the rotary cutting device is no longer being supplied with electrical energy for example. For example, the energy storage arrangement is "pre-charged" when the cutting roller and the anvil roller are in their normal operating mode. For the purposes of stopping the device (triggered-off by an emergency stop for example), a "barrier" is released in order to enable the separating movement to be effected.

It is expedient if the cutting roller is mounted such as to be movable in translatory manner. In consequence, a separating movement can be achieved in a simple manner. Hereby, a bias force can also be exerted on the cutting roller in a simple manner in order to enable it to press against the anvil roller.

In one embodiment, the cutting roller is arranged above the anvil roller taken with reference to the direction of the force of gravity. A simple constructional structure of the rotary cutting device thereby results.

In particular, the lifting device is constructed in such a manner that the cutting roller is adapted to be lifted off the anvil roller in a lifting-direction opposed to the direction of the force of gravity. A corresponding rotary cutting device can be realized in a constructionally simple manner.

It is expedient if the lifting device comprises one or more resettable devices. The cutting roller and the anvil roller can thereby be placed in an operating mode for the cutting process in a simple manner and a separating movement of the cutting roller and the anvil roller can be achieved in a simple manner.

For example, the lifting device comprises one or more resilient elements such as springs which can also serve as energy storage arrangements. These springs are pre-tensioned, for example, when the cutting roller is pressed onto the anvil roller in order to accomplish cutting movements. If a "barrier" for the resilient elements is raised, then, for example, they can press the cutting roller away from the anvil roller in order to provide the lifting action.

The lifting device can also comprise one or more pneumatic or hydraulic devices in order to provide a means for moving the cutting roller away from the anvil roller.

It is expedient if the at least one resettable device is pre-tensioned by the process of supporting the cutting roller on the anvil roller, i.e. if the pre-tensioning process occurs in the normal operating mode (cutting mode). An energy storage arrangement is thereby made available which will cater for an automatic lifting process (without the necessity to supply further energy). In particular thereby, a defined lifting process can be achieved in the case of an emergency stop.

In accordance with an embodiment of the invention, a brake device is associated with the cutting roller and/or the anvil roller.

In consequence, a defined braking of the cutting roller and/or the anvil roller can also be achieved especially in the case of an emergency stop.

Such a brake device or such brake devices can co-operate with the lifting device described above, although such co-operation is not of compelling necessity.

By virtue of the provision of a brake device or the brake devices, a drive for the cutting roller can also be implemented in a simpler manner since it is possible to design it for smaller forces due to the defined braking action.

For example, a brake device control system is coupled to a drive control system for the rotary cutting device. A defined braking process can thereby be achieved when the drive is stopped for example.

It is expedient if a brake device control system is coupled to a lifting device control system for a lifting device for the purposes of moving the cutting roller and the anvil roller apart. Thus, in addition to the lifting of the cutting roller and the anvil roller relative to one another, braking of the cutting roller and the anvil roller can also be achieved.

In one advantageous embodiment, the brake device comprises at least one disc brake. A defined braking of the cutting roller and/or the anvil roller can thereby be achieved in a simple and space-saving manner.

It is expedient if the cutting roller is adapted to be pressed against the anvil roller for a cutting process. A defined contact pressure can thus be made available for a cutting process.

Furthermore, in accordance with an embodiment of the invention, a damping device (attenuation device) is associated with the cutting roller and/or the anvil roller whereby the relative translatory motion of the cutting roller and the anvil roller towards one another is controllable by means of said device.

In a normal operating mode (cutting mode) of a rotary cutting device, the problem can also occur that a certain portion of a web of material will be thicker. This can lead to the cutting roller being lifted off the anvil roller. Then, when a portion of the material of "normal" thickness is subsequently transported through the rotary cutting device, the previously lifted cutting roller then moves towards the anvil roller. This can lead to the cutting roller striking the anvil roller with a hard blow and to resilient contraction of the at least one-support ring. This can in turn result in a cutter device of the cutting roller striking the anvil roller with a hard blow. This leads to increased wear of the cutting edges and in the worst case can lead to the destruction of a cutter blade. (Cutter devices are often made of brittle materials such as hard metal materials which are particularly sensitive to hard impacts.)

The damping device provides for a controlled motion of the cutting roller and the anvil roller towards one another (in particular with regard to the speed and/or the acceleration/deceleration thereof) in order to prevent hard knocks. In particular, this movement towards one another can be slowed down so as to prevent a hard impact. This results in a reduced susceptibility to faults.

In particular, the damping device is adjusted in such a manner that the impact speed and the impact force of the cutting roller on the anvil roller are so small that substantially no additional resilient contraction of the at least one support ring takes place. Impact of a cutter device of the cutting roller on the anvil roller is thereby prevented.

It is expedient for the damping device to be formed in such a manner as to enable the separating movement of the cutting roller and the anvil roller to be rapid in comparison with the movement thereof together. For example, lifting of the cutting roller from the anvil roller by means of a lifting device such as that described above is thereby possible in order to prevent the sliding friction of the cutting roller and the anvil roller.

In particular, the damping device is arranged between a machine frame and the cutting roller. The damping device can be supported by the machine frame.

In particular, the damping device comprises at least one damping element in order to prevent a hard impact.

For example, a first damping element is connected to a first end face of the cutting roller and a second damping element is connected to a second end face of the cutting roller. The connection can be direct or indirect. For example, a damping element is connected to a bearing house of the cutting roller which is in contact with the corresponding end face. A hard impact can be prevented in an effective manner by means of damping elements which are arranged on opposite sides of the cutting roller.

In particular, the at least one damping element is an oil damper. A hard impact can thereby be prevented in a simple and effective manner, whereby rapid braking of the relative motion between the cutting roller and the anvil roller as they move towards one another can be provided.

It is expedient if the at least one damping element is arranged on a lever arm. An effective grip can thereby be achieved with an effective enlargement of the path.

It is especially very advantageous, if the at least one support ring is arranged on the cutting roller and if a cutter device of the cutting roller is set back relative to a supporting surface of the at least one support ring in a radial direction with respect to an axis of rotation of the cutting roller, wherein the radial spacing between the cutter device and the supporting surface is adjusted in dependence on the modulus of elasticity of the at least one support ring in such a manner that the cutter device virtually touches the anvil roller when a bias force that is effective between the cutting roller and the anvil roller is exerted. It is particularly advantageous, if a cutter device and a cutter supporting device (the working region of the anvil roller) cooperating therewith are made of a hard metal at least in the surface portions thereof. A precision cut can then be obtained even in the case of high-strength materials, such as very high tensile aramide fibre nets or steel nets for example, whereby only minimal wear of the cutter device occurs. Since there is a danger of breakage of the cutter device when using hard metals for the cutter device and the cutter support, provision is made for the cutter device to extend radially with respect to the axis of rotation of the cutting roller to a lesser extent than the supporting surfaces of the at least one support ring. Thus, in the unloaded state of the rotary cutting device, the cutter device is set back relative to the supporting surface in the radial direction. The radial spacing between the cutter device and the supporting surface is achieved in dependence on the modulus of elasticity of the at least one support ring, i.e. in dependence on the elasticity of the particular material being used for the support ring. When a bias force is exerted between the cutting roller and the anvil roller, there is a radial deformation of the at least one support ring so that the radial extent of the at least one support ring with respect to the axis of rotation of the cutting roller is reduced in dependence on the particular modulus of elasticity. The relative spacing between the cutter device and the cutter support in the unloaded state of the rotary cutting device is selected in such a manner that the cutter device virtually touches the anvil roller when in the loaded state (i.e. when the bias force is being exerted), i.e. the cutter device is opposed to the cutter support on the anvil roller by the least possible spacing or lightly touches it. Such a light touch ensures a reliable cut on the one hand and breakage of the cutter device is thereby prevented as also is damage to the anvil roller prevented on the other. The off-setting of the cutter blade is described in EP 1 186 387 A2 to which reference is expressly made.

Furthermore, it is expedient if the cutting roller and/or the anvil roller is self-tensioned. An advantageous mode structure can thereby be achieved. Such a pre-tensioning effect is described in EP 1 238 765 A2 to which reference is expressly made.

In accordance with the invention, a method for disengaging a rotary cutting device comprising a rotatably mounted cutting roller and an anvil roller is provided by virtue of which method the susceptibility to faults of the rotary cutting device can be reduced.

In accordance with an embodiment of the invention, the cutting roller and the anvil roller are moved away from one another in a translatory manner when disengaging the arrangement.

In particular, the cutting roller is lifted up from the anvil roller in order to prevent sliding friction between the cutting roller and the anvil roller. The contact of foreign bodies with a cutter device of the cutting roller can also be prevented by this lifting action.

For example, the separating movement is initiated if the rotary motion of the cutting roller and/or anvil roller exceeds/falls below a threshold value. In particular, it is initiated when the drive for the cutting roller is stopped. It can also be initiated by a fault signal such as a signal produced when a foreign body is detected for example.

It is expedient, if the rotary motion of the cutting roller and/or the anvil roller is braked by a brake device. A defined braking process can be achieved thereby.

Furthermore, in accordance with the invention, a method of operating a rotary cutting device comprising a rotatably mounted cutting roller and an anvil roller is provided by virtue of which a reduced susceptibility to faults of the rotary cutting device is achieved.

In accordance with an embodiment of the invention, the movement of the cutting roller towards the anvil roller after the cutting roller has been lifted off the anvil roller due to an effect of the goods being cut is controlled by a damping device in order to prevent the cutting roller striking the anvil roller with a hard impact.

The following description of preferred embodiments taken in conjunction with the drawing serves to provide a more detailed explanation of the invention.

DETAILED DESCRIPTION OF THE INVENTION

Figure 1:
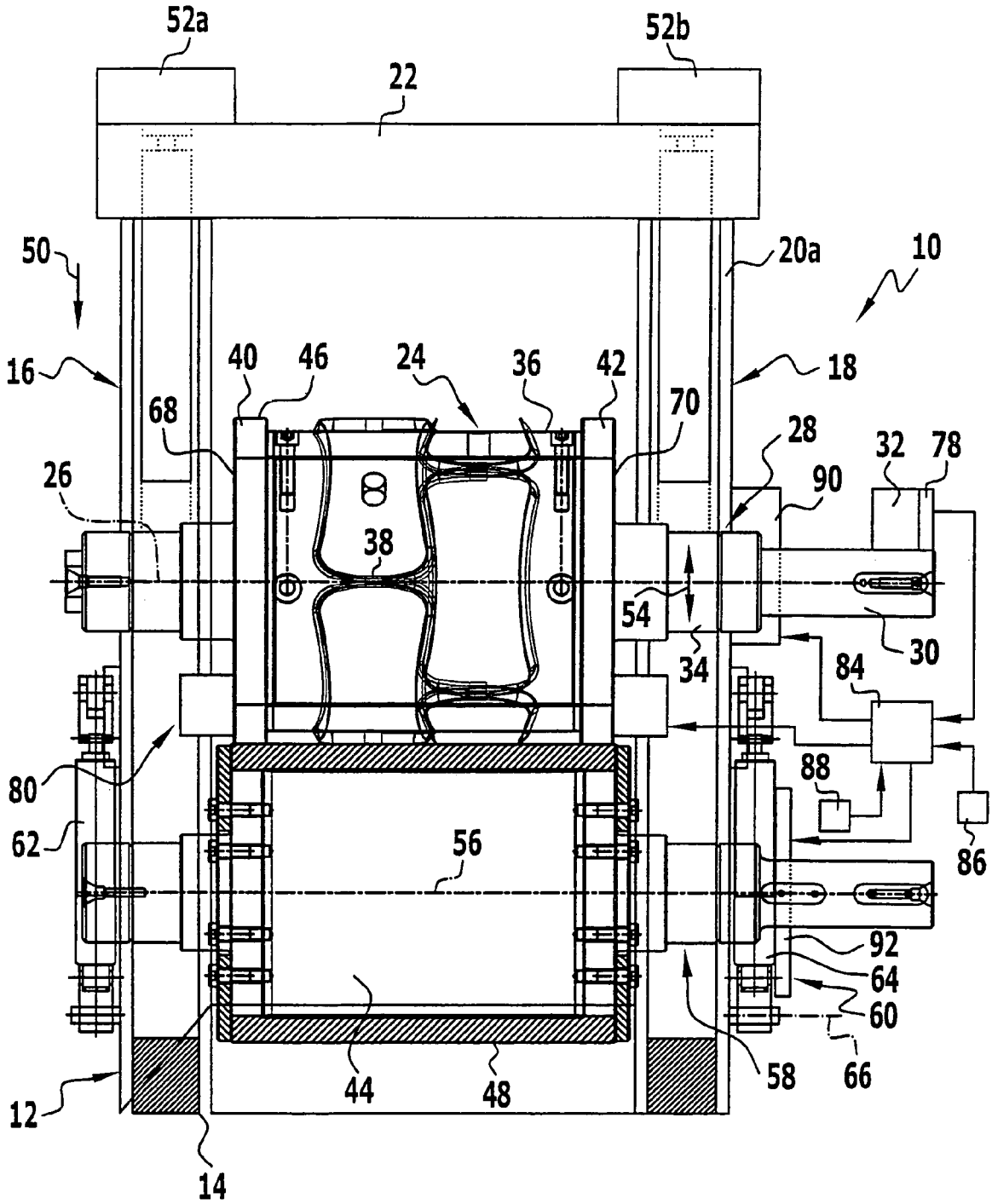
FIG. 1 shows a schematic front view of an exemplary embodiment of a rotary cutting device in accordance with the invention.
Figure 2:
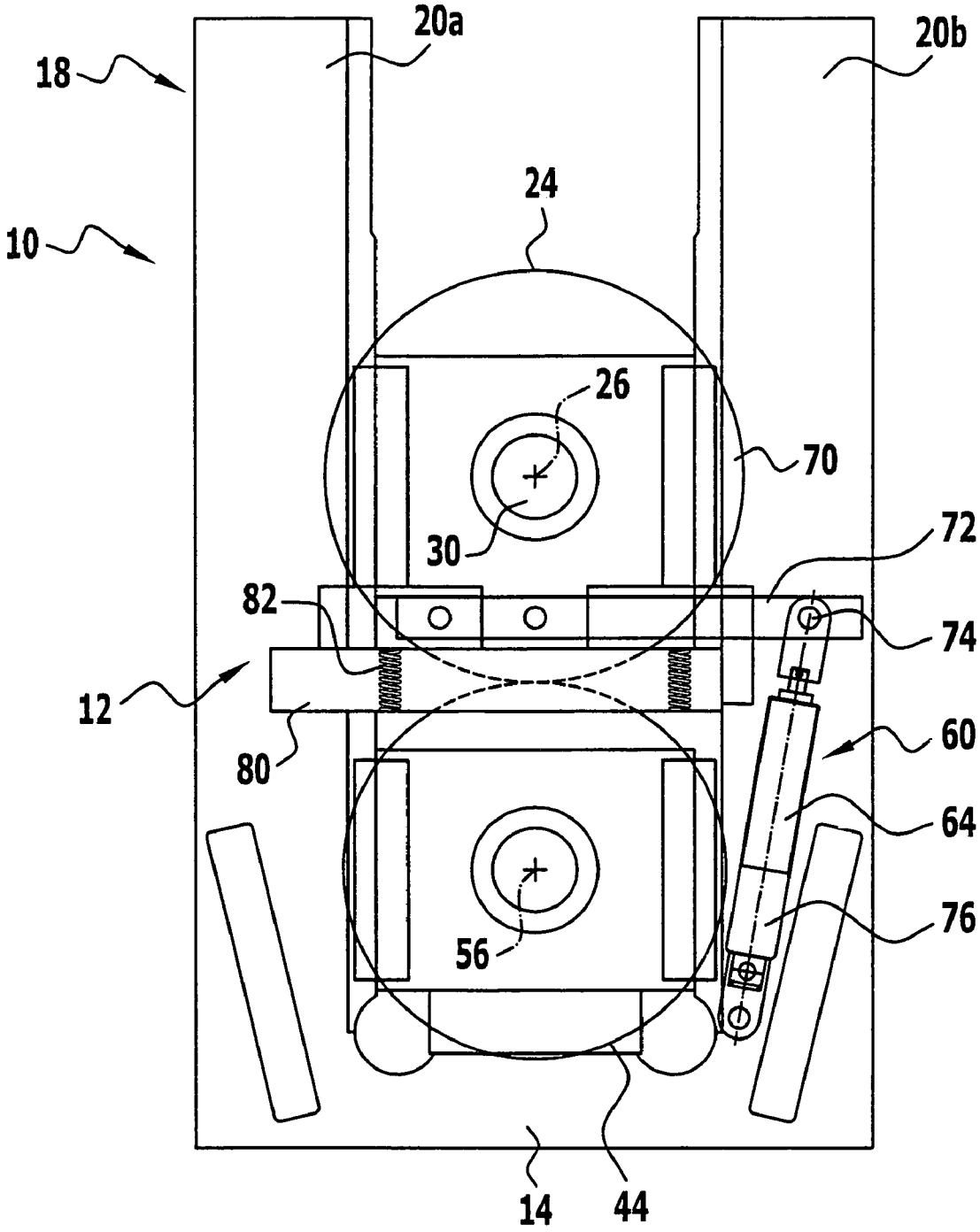
FIG. 2 a partial side view of the rotary cutting device according to FIG. 1.

An exemplary embodiment of a rotary cutting device in accordance with the invention which is shown in FIGS. 1 and 2 and is designated by 10 therein comprises a machine frame 12. This machine frame 12 comprises, for example, a base 14 by means of which the rotary cutting device 10 is adapted to be placed on a supporting surface. Portal-like supports 16, 18 are arranged on the base 14, wherein a support 16, 18 comprises spaced pillars 20*a*, 20*b* extending in the vertical direction.

The supports 16, 18 are connected by a cross beam 22.

A driven cutting roller 24 is mounted on the machine frame 12 such as to be rotatable about an axis of rotation 26, wherein an appropriate bearing arrangement 28 is provided for mounting purposes.

The cutting roller 24 comprises a shaft 30 which is coupled to a drive 32 and in particular to a drive motor. The shaft 30 can be set into rotary motion with the aid of the drive 32. Furthermore, the cutting roller 24 comprises a bearing portion 34 via which the cutting roller 24 is supported on the bearing arrangement 28 on the machine frame 12.

The cutting roller has a cylindrical portion 36 which is positioned between the supports 16, 18. This cylindrical portion 36 carries a cutter device 38 comprising cutting edges, whereby the arrangement and the construction of the cutter device 38 on the cylindrical portion 36 are determined by the special application of use (i.e. by the cutting contour that is to be obtained).

The cutting roller 24 comprises a first support ring 40 and a spaced second support ring 42 via which the cutting roller 24 is supported on an anvil roller 44 during a cutting process. The support rings 40, 42 are arranged and constructed such as to be rotationally symmetrical with respect to the axis of rotation 26. They comprise a cylindrical supporting surface 46 which is effective to provide support therefor on the anvil roller 44.

The cutting edges of the cutter device 38 are, for example, made of a hard metal at least in a surface portion thereof. This may, for example, be a sintered material based on tungsten with a bonding agent based on cobalt or a material containing titanium carbide.

Provision may also be made for a working region 48 of the anvil roller 44 to be made of a hard metal material at least in a surface portion thereof.

The cutting roller 24 is adapted to be pressed against the anvil roller 44 in the direction 50 for the purposes of carrying out the cutting process. To this end, there are provided appropriate adjustment devices 52*a*, 52*b* which are arranged to at least a partial extent on the cross beam 22 for example. The cutting roller 24 can, for example, be pressed pneumatically against the anvil roller 44 by means of the adjustment devices 52*a*, 52*b* for the purposes of applying a contact pressure. A bias force can be exerted on the cutting roller 24 by means of the adjustment devices 52*a*, 52*b*.

Provision is made for the cutter device 38 serving as a cutting tool to be set back relative to the supporting surface 46 of the support rings 40, 42 in a radial direction with respect to the axis of rotation 26 of the cutting roller 24 (when the support rings 40, 42 are not resiliently deformed). The radial spacing between the cutter device 38 (i.e. between the points of the cutter device 38 at the greatest distance from the axis of rotation 26) and the supporting surface 46 of the support rings 40, 42 is set in such a manner in dependence on the modulus of elasticity of the support rings 40, 42 that the cutter device 38 virtually touches the working region 48 of the anvil roller 44 when a bias force that is effective between the cutting roller 24 and the anvil roller 44 is being exerted.

This solution is particularly advantageous when the cutter device 38 and the working region 48 of the anvil roller 44 cooperating therewith are made of hard metal at least in the surface portions thereof. A precision cut can then be produced, whereby only minimal support of the cutter device 38 on the working region 48 is established. In turn, the life span can thereby be increased.

Such a rotary cutting device is described in EP 1 186 387 A2 or in US 2002/0029675 A1 to which reference is expressly made.

The cutting roller 24 is mounted on the machine frame 12 in a translatory manner. This is indicated in FIG. 1 by the direction-indicative double arrow 54. It is thereby possible to provide a translatory movement of the cutting roller 24 in the vertical direction and in the opposite direction 50.

The anvil roller 44 is mounted on the machine frame 12 in rotatable but non-translatory manner. A corresponding axis of rotation 56 is aligned parallel to the axis of rotation 26 of the cutting roller 24. The axes of rotation 26 and 56 are spaced by a distance D during a cutting process.

The working region 48 of the anvil roller 44 is in the form of a cylinder. The cutting roller 24 is supported on the anvil roller 44 with the aid of its support rings 40, 42 (wherein the support rings 40 and 42 are of substantially identical construction).

The anvil roller 44 can be driven or be freely rotatable.

A bearing arrangement 58 is provided for mounting the anvil roller 44 on the machine frame 12 in a rotary manner.

When the rotary cutting device 10 is in operation, a web of material of the goods to be cut is fed-through between the cutting roller 24 and the anvil roller 44, whereby the cutter device 38 is effective "periodically" on the goods to be cut.

If the goods to be cut are of non-uniform thickness, it can happen hereby that the cutting roller 24 will be lifted up from the anvil roller 44 in a direction opposite to the direction 50. When the thickened portion of the material has passed through the rotary cutting device 10, the cutting roller 24 then moves back towards the anvil roller 44 due to the bias force.

There is provided a damping device 60 which serves to prevent a hard impact in the course of the movement of the cutting roller 24 towards the anvil roller 44.

The damping device 60 comprises a first damping element 62 and a second damping element 64 for example, wherein these damping elements 62, 64 are arranged to be articulated and in particular are pivotal on the machine frame 12 at or in the proximity of one end thereof. Hereby, a corresponding pivotal axis 66 is aligned substantially parallel to the axis of rotation 26.

The damping elements 62, 64 are articulated to a respective end face 68, 70 either directly or through the intermediary of appropriate connecting arrangements 72 (FIG. 2). Such a connecting arrangement 72 is designed in particular as a lever arm, i.e. a connecting point 74 (FIG. 2) of the corresponding damping elements 62, 64 whereat it is articulated to the connecting arrangement 72 is located at a distance from the axis of rotation 26 of the cutting roller 24. A larger possible displacement path and thus a better coupling force can thereby be obtained.

The coupling of the damping elements 62, 64 to the end faces 68, 70 of the cutting roller 24 can be effected via the bearing arrangement 28 for example.

The damping elements 62, 64 are, for example, implemented in the form of an oil damper 76 (hydraulic damper) which comprises a piston that can move in a linearly displaceable manner in a piston chamber.

The damping device 60 is supported on the machine frame 12 and the cutting roller 24. It is formed in such a way that rapid lifting of the cutting roller from the anvil roller 44 is possible, i.e. in such a way that the lifting action is not hindered to a substantial extent by the damping device 60. However, the movement of the cutting roller 24 towards the anvil roller 44 (with the danger of a hard impact) is controlled in a dampening manner by the damping device 60, i.e. it is slowed down and retarded in such a way that a hard impact is prevented. Hereby, the damping elements 62, 64 are adjusted in such a way that the impact speed of the cutting roller 24 on the anvil roller 44 is such that no substantial additional resilient contraction of the support rings 40, 42 takes place.

In consequence, the danger of a hard impact does not have to be taken into consideration when adjusting the set-back of the cutter device 38 relative to the supporting surfaces 46.

In particular, during the movement of the cutting roller 24 towards the anvil roller 44, work must be performed against the oil pressure of the oil dampers 76, this thus producing the appropriate damping. Due to the oil damper, "rapid" braking of the translatory movement of the cutting roller 24 towards the anvil roller 44 can be achieved. For example, provision is made for the motion of the cutting roller 24 towards the anvil roller 44 to be stopped within at most one second.

The damping elements 62, 64 are always in contact with the machine frame 12 and the cutting roller 24 via the connecting arrangement 72.

When the rotary cutting device 10 is in operation, the cutting roller 24 rotates and is supported thereby on the anvil roller 44 via the support rings 40, 42. The cutting roller 24 is driven by the drive 32. A drive control system 78 for example, is associated with the drive 32.

Hereby, the problem can occur that if the drive 32 for the cutting roller 24 is switched off, the cutting roller 24 will slide on the anvil roller 44 due to the decrease in the contact pressure of the cutting roller 24 on the anvil roller 44. (The cutting roller 24 will usually continue to rotate when the drive 32 is switched off due to its mass inertia.) Due to the inertia of the cutting roller 24, stoppage of the rotation of the cutting roller 24 will not necessarily be achieved immediately when the drive 32 is switched off. The wear of the support rings 40, 42 is increased by the sliding friction of the cutting roller 24 on the anvil roller 44. There is also the danger of cold welding.

In accordance with the invention, there is provided a lifting device 80 by means of which the cutting roller 24 and the anvil roller 44 can be moved apart in order to prevent any sliding friction of the cutting roller 24 on the anvil roller 44. The lifting device works in such a way that the spacing between the axes of rotation 26 and 56 is increased in such a way that the support rings 40, 42 no longer touch the anvil roller 44. In consequence, mechanical contact between the cutting roller 24 and the anvil roller 44 is prevented so that sliding friction also cannot occur.

The cutting roller 24 is lifted away from the anvil roller 44 against the bias force of the adjustment devices 52*a*, 52*b* by means of the lifting device 80.

The lifting device 80 is supported on the machine frame 12 and the cutting roller 24 in order to enable the latter to be lifted away.

To this end for example, pneumatic elements or hydraulic elements or spring elements can be provided. Electromagnets could also be provided for example.

In principle, it is advantageous if the lifting device comprises resettable devices such as springs, pneumatic or hydraulic devices for example. In particular, these devices are pre-tensioned; the lifting device 80 is not effective during a normal cutting movement wherein the corresponding devices are in an inactivated position of use (indicated in FIG. 2 by springs 82). When activated, the corresponding devices then become effective and lift the cutting roller 24 away from the anvil roller 44. An energy storage arrangement for the lifting action is made available by means of the pre-tensioning process.

Due to the resettable nature of the arrangement, the cutting roller 24 can, for example, be pressed back again against the anvil roller 44 by the adjustment devices 52*a*, 52*b* in order to enable a return to the normal cutting action.

The actuation of the lifting device 80 for moving the cutting roller 24 away is controllable by a lifting device control system 84. The action of lifting the cutting roller 24 up from the anvil roller 44 is adapted to be initiated by said system. In particular, a "barrier" such as a mechanical or an electromagnetic switch for an energy storage arrangement is raised by the lifting device control system 84 so that pre-tensioned devices such as springs, pneumatic elements or hydraulic elements are caused to be effective on the cutting roller 24 for the purpose of lifting it.

In particular, the lifting device control system 84 is coupled to the drive control system 78 in such a manner that the action of exceeding/falling below a threshold value for the rotary motion of the cutting roller 24 and in particular a drive-stoppage signal for the cutting roller 24 is communicated to the lifting device control system 84. The latter can then initiate the process of lifting the cutting roller 24. For example, the lifting device control system 84 is informed as to whether a threshold value for the speed and/or the acceleration and/or the deceleration of the cutting roller 24 is exceeded and/or whether they have fallen below the threshold value. It is in principle also possible for one or more threshold values to be stored in the lifting device control system 84 and for these to be checked in regard to the action of exceeding/falling below the threshold value.

It is also expedient if the lifting device control system 84 is coupled to an emergency stop device 86. In this case, automatic lifting of the cutting roller 24 can be effected when an emergency stop signal for the rotary cutting device 10 is triggered-off.

Provision may also be made for the lifting device control system 84 to be coupled to one or more sensors 88. For example, the lifting device control system 84 is coupled to material sensors. If, for example, a foreign body such as a metallic foreign body is detected in the material that is to be cut, then lifting of the cutting roller 24 from the anvil roller 44 can be effected automatically in order to prevent contact of the metallic material with the cutter device 38.

A brake device 90 is associated with the cutting roller 24. This comprises one or more disc brakes for example. If the cutting roller 24 is no longer being driven due to the drive 32 being switched off, then a defined braking process can be produced by the brake device 90. In particular, more rapid stoppage of the rotation of the cutting roller 24 can be achieved thereby. In consequence, a genuine "emergency stop" of the cutting roller 24 can take place.

The brake device 90 is coupled to the lifting device control system 84 for example or it can be coupled directly to the drive control system 78. It could also be coupled directly to the emergency stop device 86.

In consequence, automatic braking of the cutting roller 24 can be achieved with the lifting of the cutting roller 24 from the anvil roller 44 for example.

A brake device 92, which comprises one or more disc brakes for example, can also be associated with the anvil roller 44. The rotation of the anvil roller 44 can be braked by the brake device 92. Hereby, coupling to the lifting device control system 84 or directly to the drive control system 78 or the emergency stop device 86 can again be provided. A defined process of braking the anvil roller 44 can be achieved by the brake device 92 in order to prevent a web of material from rolling up for example.

The cutting roller 24 (and also the anvil roller 44) can be pre-tensioned (preferably substantially parallel to the axis of rotation 26) in order to obtain an advantageous mode structure in regard to oscillations of the cutting roller 24. This is described in EP 1 238 765 A2 and in the US 2002/0144580 A1 to which reference is expressly made.

The rotary cutting device in accordance with the invention functions as follows:

In normal operation (a cutting operation) of the rotary cutting device 10, a web of material is fed-through between the cutting roller 24 and the anvil roller 44. The cutting roller 24 is pressed onto the anvil roller 44 by means of a certain biasing force (adjusted by the adjustment devices 52*a*, 52*b*). The cutting roller 24 are driven in rotary manner and form outline cuts in the web of material.

If the cutting roller 24 is lifted off the anvil roller 44 due to an increase in the thickness of the material and is then moved back again towards the anvil roller 44, then the damping device 60 prevents a hard impact from occurring, i.e. the cutting roller 24 is moved towards the anvil roller 44 at a reduced speed due to the damping device 60. In particular, this thereby prevents resilient contraction of the support rings 40, 42 which could lead to the cutter device 38 striking "hard" against the working region 48.

When disengaging the rotary cutting device 10 (be this an intended disengagement process or due to an emergency stop) the cutting roller 24 is lifted off the anvil roller 44 by the lifting device 80 in order to remove the mechanical contact between the cutting roller 24 and the anvil roller 44. The sliding friction between the cutting roller 24 and the anvil roller 44 (on the support rings 40, 42) is thereby prevented.

A defined process of braking the cutting roller 24 and the anvil roller 44 can be achieved by means of the brake devices 90, 92.

The sliding friction between the cutting roller 24 and the anvil roller 44 can be prevented when disengaging the rotary cutting device 10 even in the case of cutting rollers 24 and anvil rollers 44 of great mass and thus large inertia. A defined braking process can be achieved with the aid of the brake devices 90, 92.

Trouble-free operation can also be achieved in that foreign bodies in a web of material are detected by one or more sensors 88 and in the event that such a foreign body is detected then action is taken to lift the cutter device 38 from the web of material before the foreign body reaches the cutter device 38.

In the case of the rotary cutting device 10 in accordance with the invention, the drive 32 can be of smaller dimensions since there is provision for disengaging the device in a defined manner; the drive means 32 must in principle bear the forces effective in the case of an emergency stop which are larger with greater mass. These forces can be reduced by the brake device 90. Furthermore, they can be reduced by the lifting process.

The invention claimed is:

1. A rotary cutting device, comprising:

a rotatably mounted cutting roller;

an anvil roller;

at least one support ring for supporting the cutting roller on the anvil roller;

a lifting device for moving the cutting roller and the anvil roller apart with a translatory motion in order to separate the at least one support ring and the anvil roller, the translatory motion comprising a movement without any rotational component that is in a direction transverse to an axis of rotation of the cutting roller and transverse to an axis of rotation of the anvil roller;

a drive control system for the rotary cutting device; and a lifting device control system electronically coupled to the drive control system for the rotary cutting device;

wherein:

the lifting device is adapted to be activated in a controlled manner for the moving of the cutting roller and the anvil roller apart with said translatory motion; and the lifting device is adapted to be activated upon at least one of exceeding and falling below a threshold value for at least one of speed, acceleration and deceleration of at least one of the cutting roller and the anvil roller.

2. A rotary cutting device in accordance with claim 1, wherein the anvil roller is fixed in a translatory manner and the cutting roller is movable relative to the anvil roller with said translatory motion by the lifting device.

3. A rotary cutting device in accordance with claim 1, wherein the cutting roller is fixed in a translatory manner and the anvil roller is movable relative to the cutting roller with said translatory motion by the lifting device.

4. A rotary cutting device in accordance with claim 1, wherein the lifting device control system is coupled to a drive control system for the cutting roller.

5. A rotary cutting device in accordance with claim 1, wherein the lifting device control system is coupled to one or more sensors.

6. A rotary cutting device in accordance with claim 5, wherein the lifting device control system is connected to one or more cut-goods sensors.

7. A rotary cutting device in accordance with claim 1, wherein the lifting device is adapted to be activated by an emergency stop.

8. A rotary cutting device in accordance with claim 1, wherein a drive is provided for the cutting roller.

9. A rotary cutting device in accordance with claim 1, wherein the lifting device is supported on a machine frame.

10. A rotary cutting device in accordance with claim 1, wherein the lifting device comprises an energy storage arrangement.

11. A rotary cutting device in accordance with claim 1, wherein the cutting roller is mounted to be movable with said translatory motion.

12. A rotary cutting device in accordance with claim 1, wherein the cutting roller is arranged above the anvil roller taken with reference to a direction of a force of gravity.

13. A rotary cutting device in accordance with claim 1, wherein the lifting device is adapted to lift the cutting roller off the anvil roller in a lifting-direction opposed to a direction of a force of gravity.

14. A rotary cutting device in accordance with claim 1, wherein the lifting device comprises one or more resettable devices.

15. A rotary cutting device in accordance with claim 14, wherein the lifting device comprises one or more resilient elements.

16. A rotary cutting device in accordance with claim 14, wherein the lifting device comprises one or more pneumatic devices.

17. A rotary cutting device in accordance with claim 14, wherein the lifting device comprises one or more hydraulic devices.

18. A rotary cutting device in accordance with claim 14, wherein the at least one resettable device is pre-tensioned by a process of supporting the cutting roller on the anvil roller.

19. A rotary cutting device in accordance with claim 1, wherein a brake device is associated with at least one of the cutting roller and the anvil roller.

20. A rotary cutting device in accordance with claim 19, wherein a brake device control system is coupled to the drive control system for the rotary cutting device.

21. A rotary cutting device in accordance with claim 19, wherein a brake device control system is coupled to the lifting device control system for the lifting device for the purposes of moving the cutting roller and the anvil roller apart.

22. A rotary cutting device in accordance with claim 19, wherein the brake device comprises at least one disc brake.

23. A rotary cutting device in accordance with claim 1, wherein the cutting roller is adapted to be pressed against the anvil roller for a cutting process.

24. A rotary cutting device in accordance with claim 1, wherein a damping device is associated with at least one of the cutting roller and the anvil roller, a translatory relative motion of the cutting roller and the anvil roller towards each other being controllable by means of said damping device.

25. A rotary cutting device in accordance with claim 24, wherein the damping device is adjusted so that an impact speed and an impact force of the cutting roller on the anvil roller are so small that no additional resilient compression of the at least one support ring takes place.

26. A rotary cutting device in accordance with claim 24, wherein the damping device enables a separating movement of the cutting roller and the anvil roller to be rapid in comparison with a movement of the cutting roller and the anvil roller towards each other.

27. A rotary cutting device in accordance with claim 24, wherein the damping device is arranged between a machine frame and the cutting roller.

28. A rotary cutting device in accordance with claim 24, wherein the damping device comprises at least one damping element.

29. A rotary cutting device in accordance with claim 28, wherein a first damping element is connected to a first end face of the cutting roller and a second damping element is connected to a second end face of the cutting roller.

30. A rotary cutting device in accordance with claim 28, wherein the at least one damping element is an oil damper.

31. A rotary cutting device in accordance with claim 28, wherein the at least one damping element is arranged on a lever arm.

32. A rotary cutting device in accordance with claim 1, wherein:

the at least one support ring is arranged on the cutting roller;

a cutter device of the cutting roller is set back relative to a supporting surface of the at least one support ring in a radial direction with respect to an axis of rotation of the cutting roller, and a radial spacing between the cutter device and the supporting surface is set in dependence on a modulus of elasticity of the at least one support ring such that the cutter device virtually touches the anvil roller when a bias force which is effective between the cutting roller and the anvil roller is exerted.

33. A rotary cutting device in accordance with claim 1, wherein the cutting roller is self-tensioned.

* * * * *